US010682560B1

(12) United States Patent
Huang

(10) Patent No.: US 10,682,560 B1
(45) Date of Patent: Jun. 16, 2020

(54) STRIKE EXERCISER STRUCTURE

(71) Applicant: HTY SPORTS CO., LTD., New Taipei (TW)

(72) Inventor: Hsien-Cheng Huang, New Taipei (TW)

(73) Assignee: HTY SPORTS CO., LTD., New Taipei (TW)

( * ) Notice: Subject to any disclaimer, the term of this patent is extended or adjusted under 35 U.S.C. 154(b) by 0 days.

(21) Appl. No.: 16/387,536

(22) Filed: Apr. 18, 2019

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2209/00* (2013.01)

(58) Field of Classification Search
CPC ..... A63B 69/0002; A63B 21/00061; A63B 21/0083; A63B 69/0091; A63B 69/0075; A63B 63/003; A63B 2069/0008; A63B 2209/00
USPC ..... 473/417, 422, 452, 451
See application file for complete search history.

(56) References Cited

U.S. PATENT DOCUMENTS 3,874,662 A * 4/1975 Harrington ..... A63B 69/0075 473/417
3,877,697 A * 4/1975 Lersch ..... A63B 69/0075 473/417
4,057,248 A * 11/1977 Stoecker ..... A63B 69/0002 473/451
4,364,563 A * 12/1982 Stafford ..... A63B 69/0075 473/417
4,796,885 A * 1/1989 Wright ..... A63B 69/0002 473/417
5,076,580 A * 12/1991 Lang ..... A63B 69/0002 473/273
5,106,085 A * 4/1992 Lewy ..... A63B 69/0002 473/417
5,133,549 A * 7/1992 Vasquez ..... A63B 69/0091 473/148
5,156,402 A * 10/1992 Hart ..... A63B 21/00061 473/229
5,540,430 A * 7/1996 Nichols ..... A63B 69/0002 473/417
5,951,413 A * 9/1999 Guerriero ..... A63B 69/0091 473/417
5,957,790 A * 9/1999 Carfo ..... A63B 69/0002 473/422

(Continued)

*Primary Examiner* — Mitra Aryanpour
(74) *Attorney, Agent, or Firm* — Leong C. Lei

(57) ABSTRACT

A strike exerciser structure includes: a first rubber pad, defined with a swing space; a second rubber pad, in movable connection with one side of the first rubber pad and positioned inside the swing space, the second rubber pad including a swing portion and connection portion, the connection portion in connection with the first rubber pad, and the swing portion extended from one side of the connection portion; a rod, one end thereof in connection with the swing portion; and a placement portion, configured on one end of the rod away from the swing portion, allowing a placement of a ball. Whereby, if a user uses a bat to hit the rod or drive the rod to move with a swing force upon a strike exercise, the swing portion will be oscillated with the connection portion as a fulcrum and spring back to its original position, thereby increasing service life.

3 Claims, 10 Drawing Sheets

(56) References Cited

U.S. PATENT DOCUMENTS

| | | | | |
|---|---|---|---|---|
| 6,238,307 | B1 * | 5/2001 | Owen | A63B 69/0075<br>473/417 |
| 7,303,494 | B1 * | 12/2007 | Daniels | A63B 69/0002<br>473/417 |
| 8,109,844 | B1 * | 2/2012 | Quinn | A63B 69/0075<br>473/417 |
| 8,221,271 | B1 * | 7/2012 | McIntyre | A63B 69/0002<br>473/272 |
| 8,535,178 | B2 * | 9/2013 | Keller | A63B 63/003<br>473/417 |
| 8,784,239 | B2 * | 7/2014 | Harvey | A63B 69/0002<br>473/417 |
| 9,421,444 | B1 * | 8/2016 | Graham | A63B 69/0002<br>473/452 |
| 9,492,727 | B2 * | 11/2016 | Brossman | A63B 69/0075<br>473/417 |
| 10,004,967 | B1 * | 6/2018 | Paulson | A63B 69/0075<br>473/417 |
| 2015/0265895 | A1 * | 9/2015 | Goodgame | A63B 69/0002<br>473/452 |

* cited by examiner

STRIKE EXERCISER STRUCTURE

TECHNICAL FIELD OF THE INVENTION

The present invention relates to a strike exerciser structure, and more particularly to a strike exerciser structure capable of improving the service life and convenience thereof.

DESCRIPTION OF THE PRIOR ART

Since baseball has developed for quite a long time, various corresponding exercisers are also emerging in an endless stream. Among these, there is a strike exerciser developed to use a seat placed on the ground and a rod then connected to the seat, which allows a ball to be placed on the rod and a sportsman can thereby do a ball striking exercise. In addition, there are also many baseball toys for children, and they also use the relevant structure to let children experience the fun of playing baseball.

But, if a force is swung to the rod or too large to drive to the rod upon striking, it will cause the rod to fall down together with the seat, which makes a user stand the seat and rod up again, and the exercise or play can then be continued. Moreover, when falling down, it may also increase damage chance to the exerciser and reduce the service life due to factors such as impact of the exerciser on the ground.

SUMMARY OF THE INVENTION

The main object of the present invention is to provide a strike exerciser structure, capable of absorbing a strike force through the swing effect of a second rubber pad and improving use convenience by springing the second rubber pad back to its original position.

To achieve the object mentioned above, the present invention proposes a strike exerciser structure, including: a first rubber pad, defined with a swing space; a second rubber pad, in movable connection with one side of the first rubber pad and positioned inside the swing space, the second rubber pad including a swing portion and connection portion, the connection portion in connection with the first rubber pad, and the swing portion extended from one side of the connection portion; a rod, one end thereof in connection with the swing portion; and a placement portion, configured on one end of the rod away from the swing portion, allowing a placement of a ball.

With the above structure, a user may place a ball on the placement portion and then use a bat to do a ball striking exercise. When the user swings the ball, the rod will be driven to incline in a swinging direction if the rod is hit or a swinging force is overlarge, and the force at this time will be transmitted to the second rubber pad. Meanwhile, the swing portion will be flipped off the swing space and will oscillate together with the rod with the connection portion as a fulcrum, thereby absorbing and digesting the swinging force and using the elasticity of the second rubber pad itself to bring the swing portion back to its original position. At this time, the swing portion will also drive the rod back to its original position, allowing the user to continue to place the ball on the placement portion for exercise. In addition, since only the swing portion is driven to move when the rod is oscillated, the first rubber pad is not overturned as a result so than the strike exercise will not be interrupted, capable of improving the use convenience and reducing the damage chance to increase the service life because the overturn will not happen.

With the above technologies, the present invention can overcome the easy overturn of conventional strike exercisers resulting in use inconvenience and easy damage.

DETAILED DESCRIPTION OF THE PREFERRED EMBODIMENTS

Figure 1:
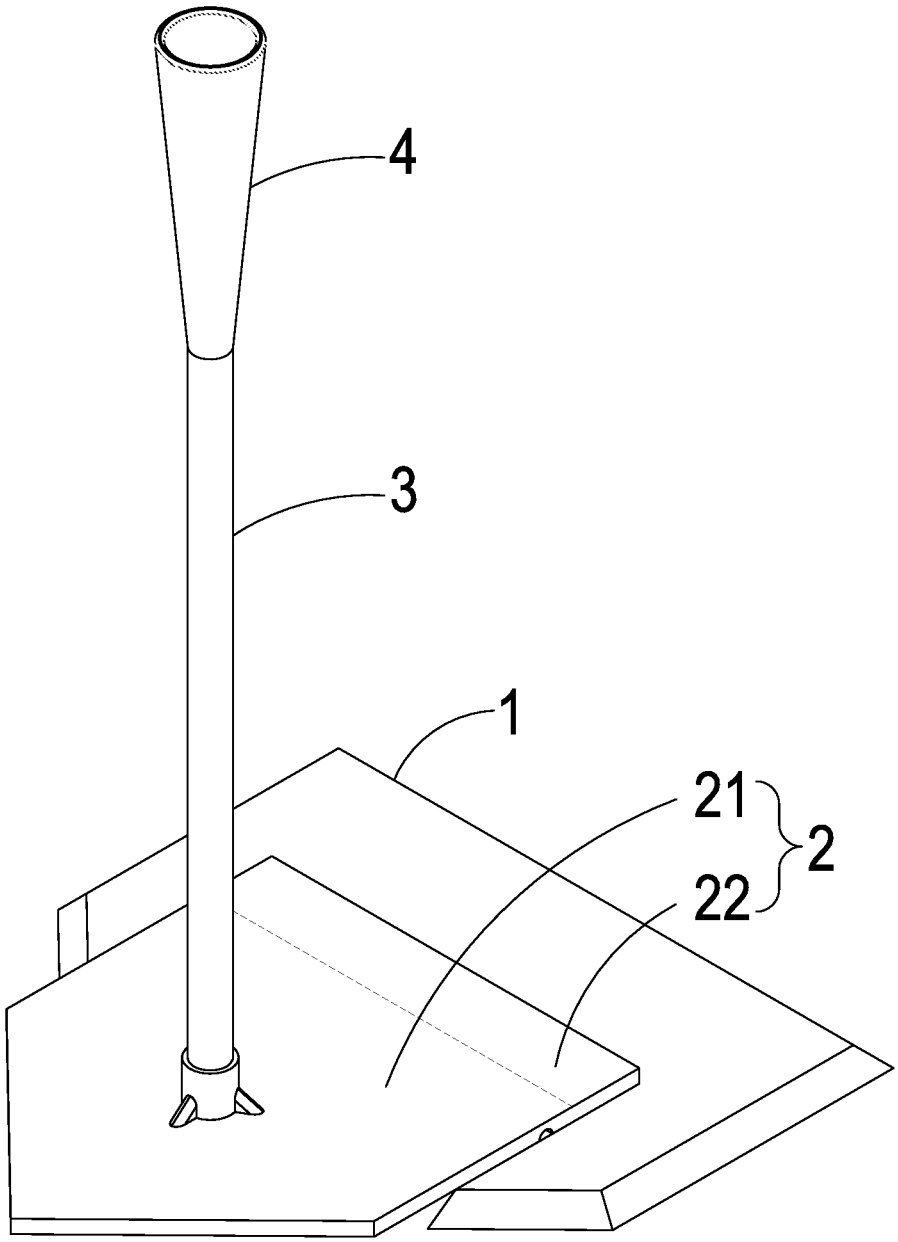
FIG. 1 is a perspective view of a first preferred embodiment according to the present invention.
Figure 2:
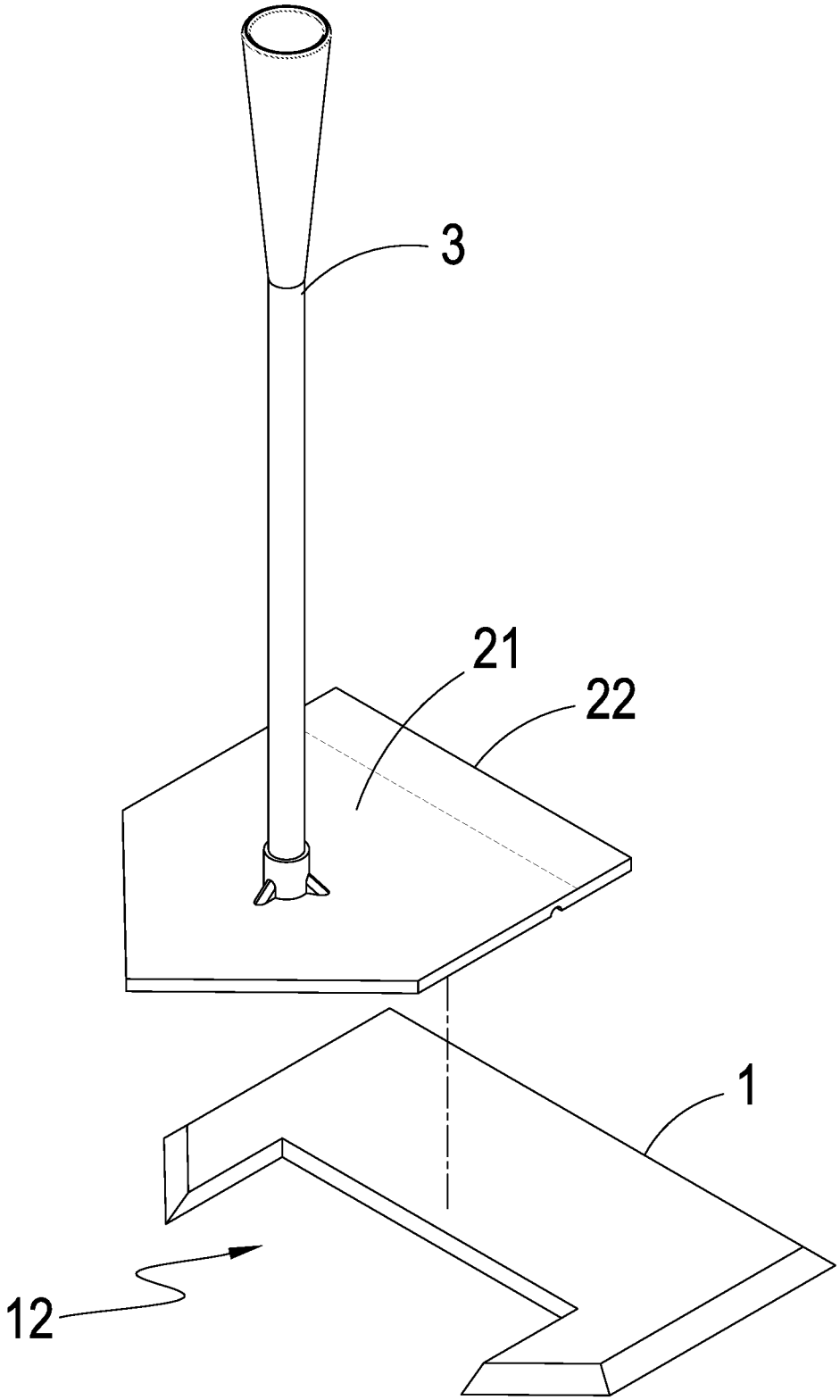
FIG. 2 is an exploded view of the first embodiment according to the present invention.
Figure 3:
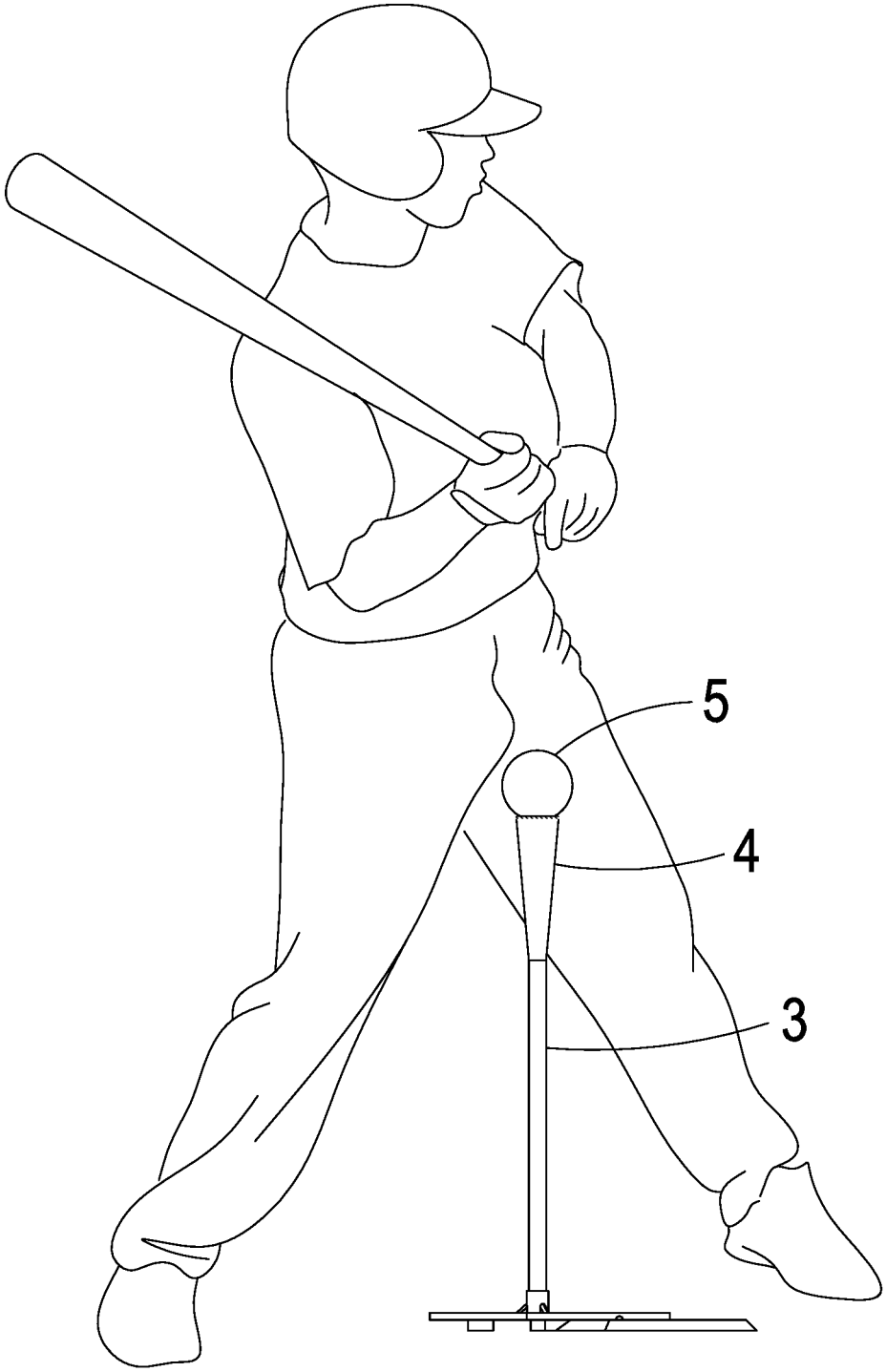
FIG. 3 is a schematic view of the first embodiment according to the present invention upon ball striking.
Figure 4:
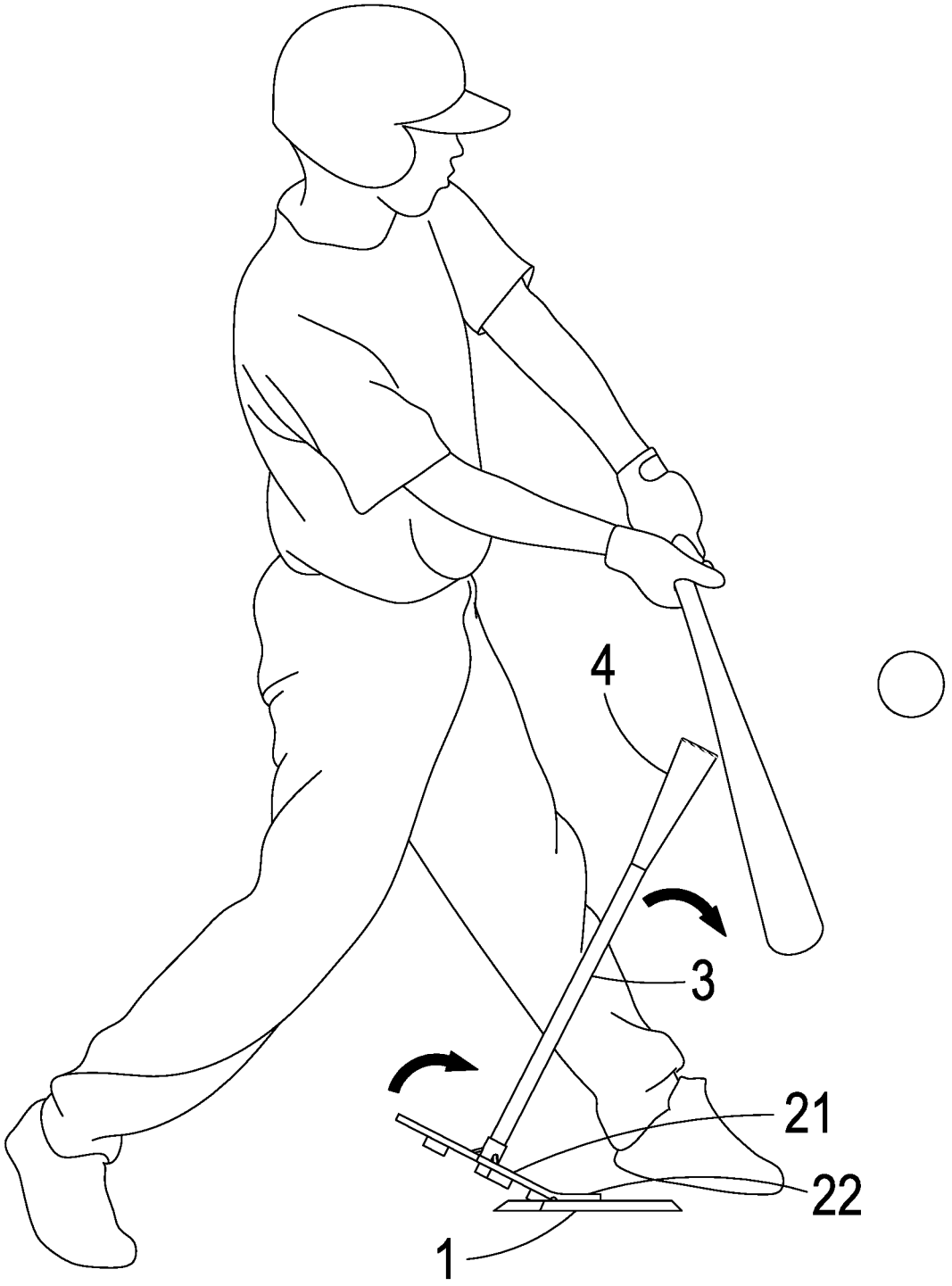
FIG. 4 is a schematic view of the first embodiment according to the present invention when a second rubber pad is oscillated.
Figure 5:
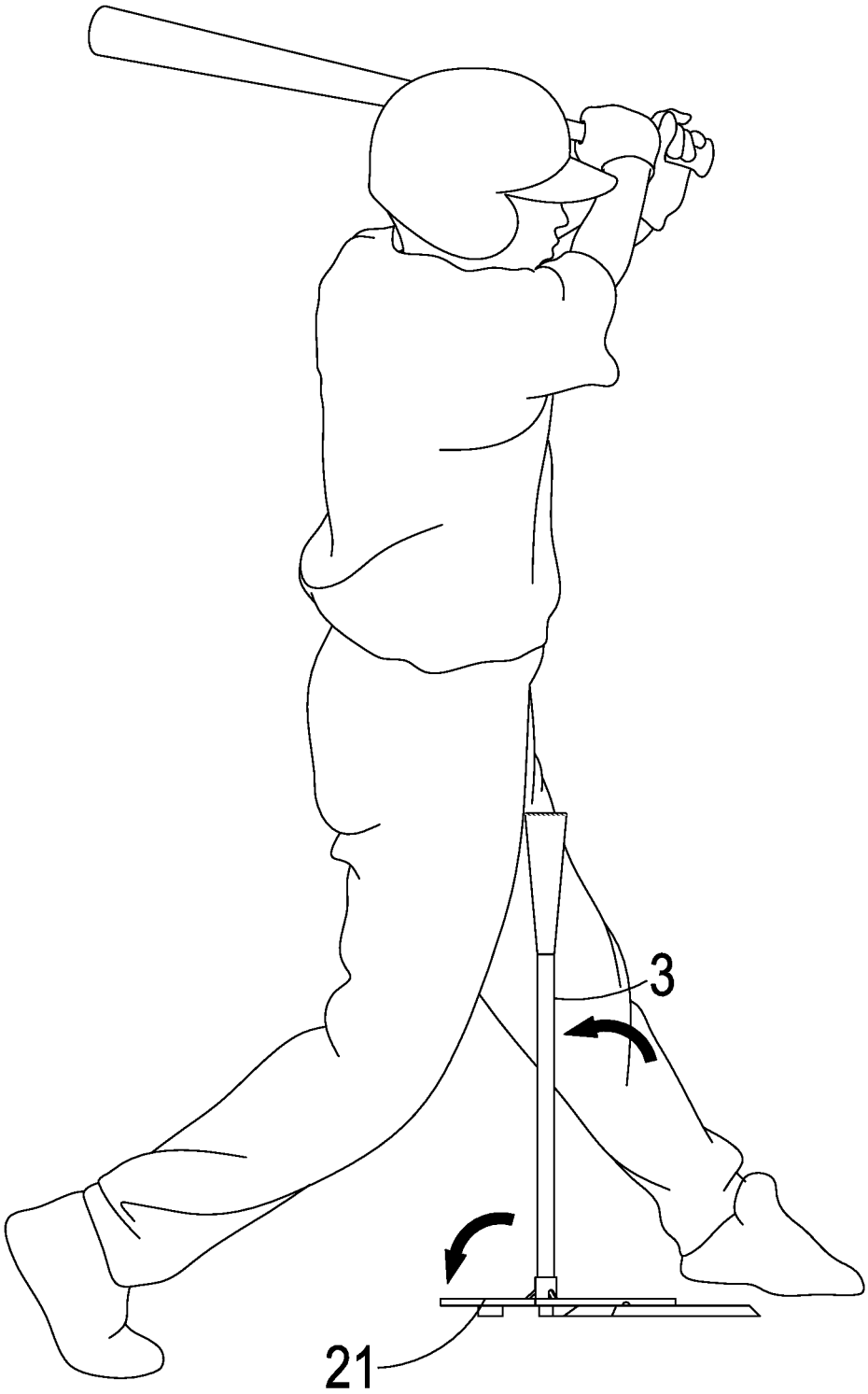
FIG. 5 is a schematic view of the first embodiment according to the present invention after the second rubber pad springs back to its original position.

Referring to FIGS. 1 and 2, a baseball exerciser structure, in a first preferred embodiment, includers a first rubber pad 1, second rubber pad 2, rod 3 and placement portion 4, where the second rubber pad 2 is in movable connection with the first rubber pad 1, and the second rubber pad 2 includes a swing portion 21 and connection portion 22, where the connection portion 22 is stuck to the first rubber pad 1, and the swing portion 21 is formed by extending from one side of the connection portion 22; the first rubber pad 1 is formed with a swing space 12 inside which the second rubber pad 2 is positioned, where the second rubber pad 2 is stuck to the first rubber pad 1 by rubber adhesive with hot pressing, thereby sticking them more stably. Furthermore, one end of the rod 3 is in connection with the upper surface of the swing portion 21, and the placement portion 4 is configured on one end of the rod 3 away from the swing portion 21.

With the above description, the structure of the present invention can be clearly understood. According to the corresponding cooperation of this structure, the service life and use convenience can be improved by the second rubber pad 2 having swing effect, and the detailed explanation will be described in the following.

Referring to FIGS. 1 to 5, a user can place a ball 5 on the placement portion 4 after the above components are assembled, where the placement portion 4 is a groove capable of the placement of the ball 5, but the present invention is not so limited. Thereafter, a bat can then be used to swing the ball 5 so as to achieve a strike exercise effect. When a user swings the ball 5, the rod 3 will be driven to incline in a swinging direction if the rod 3 is carelessly hit or a swinging force is overlarge, and the force at this time will be transmitted to the second rubber pad 2. Meanwhile, the swing portion 21 will be flipped off the swing space 12 and will oscillate together with the rod 3 with the connection portion 22 as a fulcrum, thereby absorbing and digesting the swinging force and using the elasticity of the second rubber pad 2 itself to bring the swing portion 21 back to its original position. At this time, the swing portion 21 will also drive the rod 3 back to its original position, allowing the user to continue to place the ball 5 on the placement portion 4 for exercise so as to improve the use convenience. In addition, since the overall center of gravity of the first rubber pad 1 will be increased, allowing the entirety to be more stable and not be overturned because of the force of the user's strike so that the damage chance due to the overturn can be reduced. Furthermore, the first rubber pad 1 and second rubber pad 2 are made of rubber which is more compressible and elastic than plastics, which can further reduce the damage chance so as to increase the service life.

Figure 6:
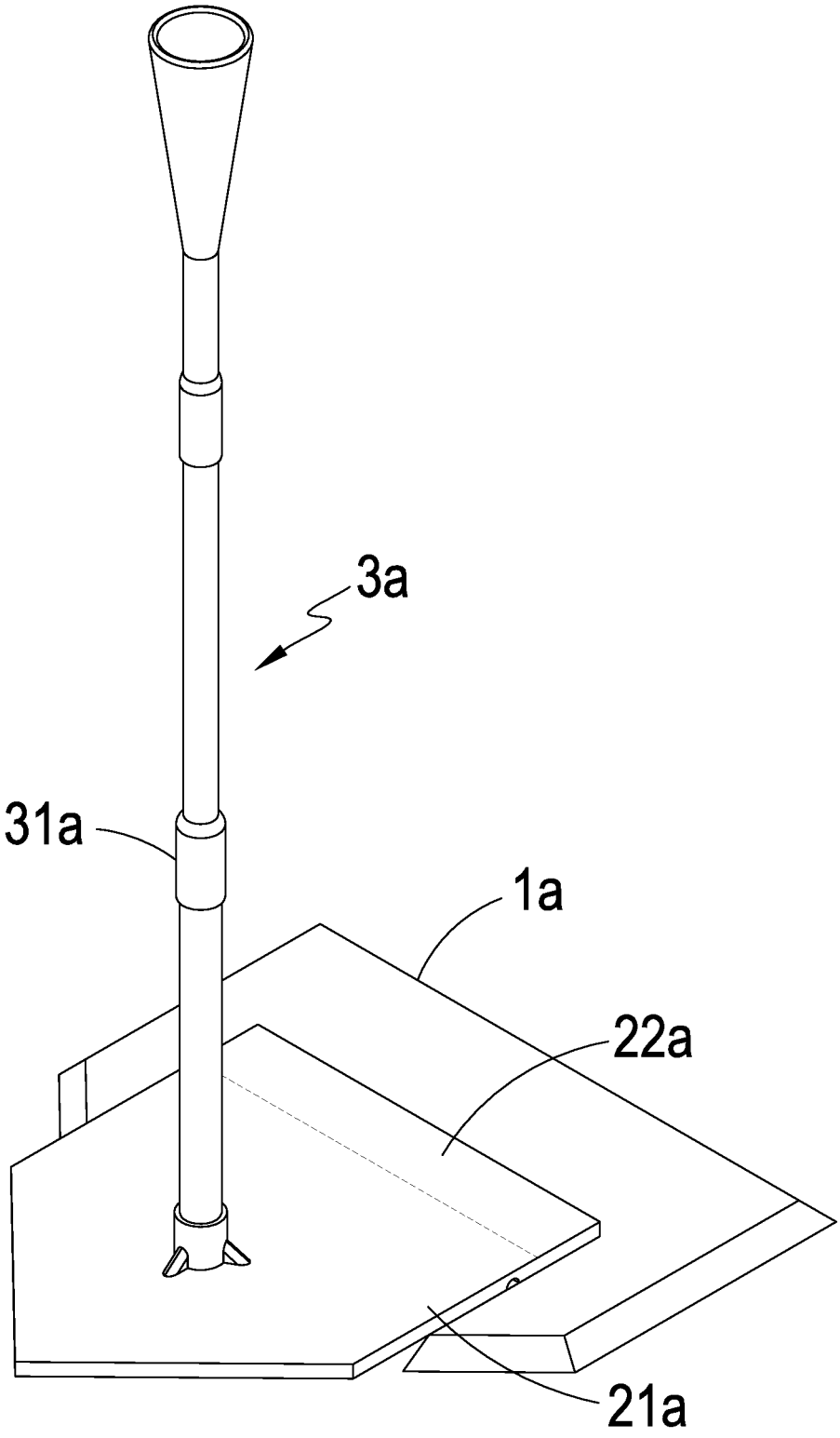
FIG. 6 is a perspective view of a second preferred embodiment according to the present invention.
Figure 7:
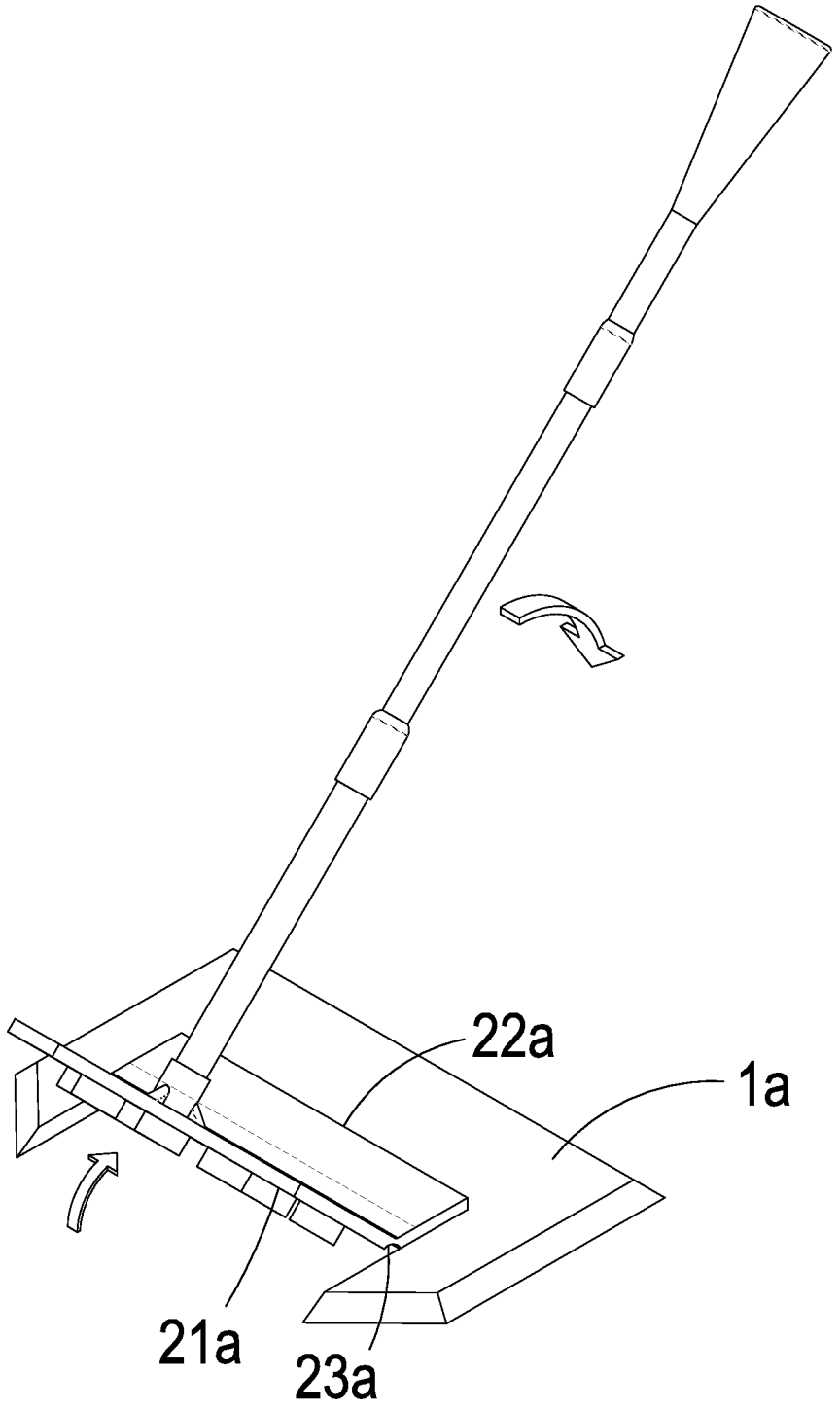
FIG. 7 is a schematically perspective view of the second embodiment according to the present invention when a second rubber pad is oscillated.
Figure 8:
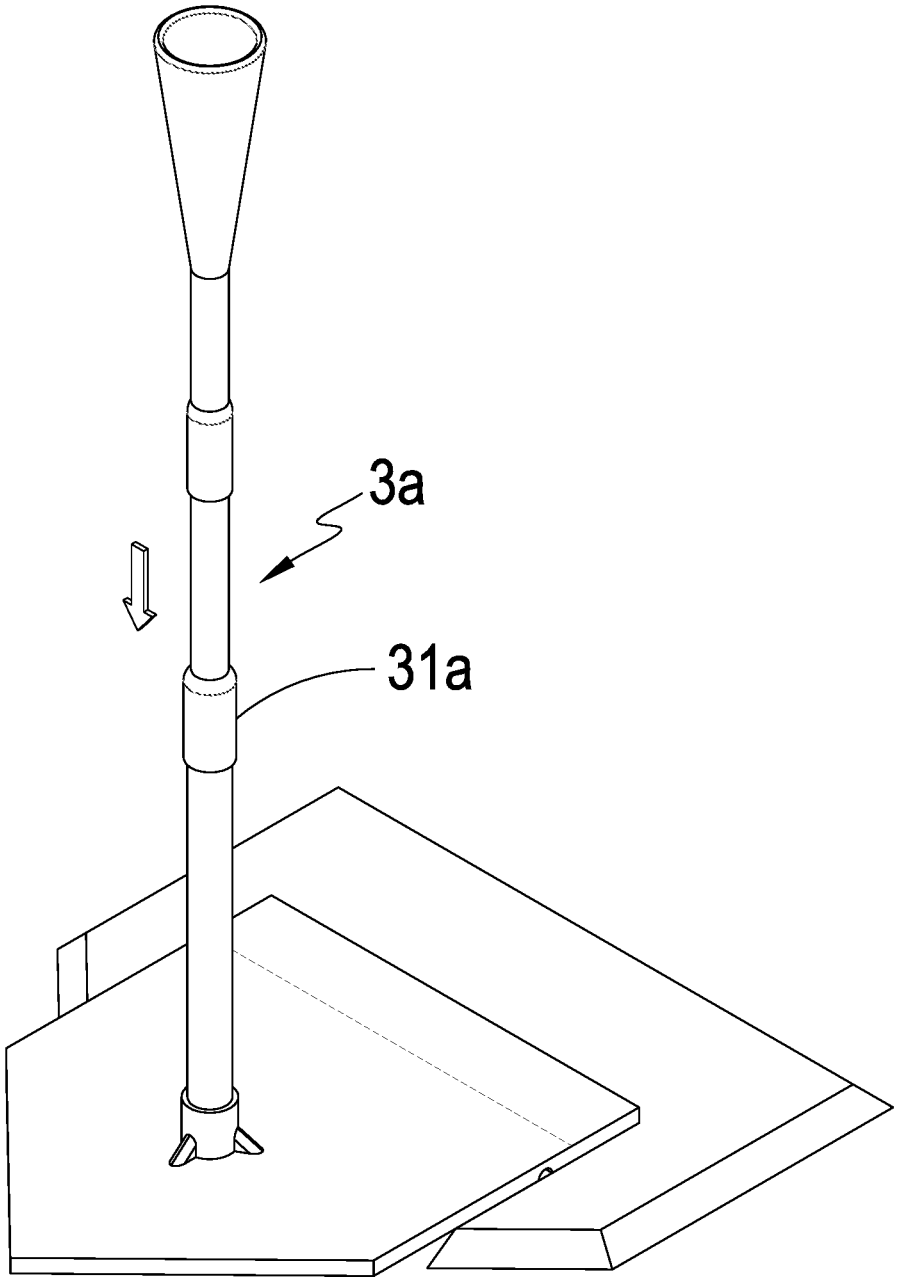
FIG. 8 is a schematically perspective view of the second embodiment according to the present invention when the length of a rod is being adjusted.

Referring to FIGS. 6 to 8, a second preferred embodiment of the present invention is shown. The present embodiment is almost similar to the above embodiment except a groove portion 23*a* is configured between a swing portion 21*a* and connection portion 22*a* in the present embodiment; the existence of the groove portion 23*a* allows a rod 3*a* being subject to a strike force to drive the swing portion 21*a* to swing to be easier and smoother. Whereby, the force is absorbed more completely and the chance of the transmission of the force to a first rubber pad 1*a* is reduced.

Furthermore, in the present embodiment, an adjusting element 31*a* is configured on the rod 3*a*, using the engagement of the rod components to allow the telescopic movement between the rod components to adjust the length of the rod 3*a*, and a sleeve is used to lock the rod components together. But, since this is a prior art, the detailed description is omitted here, and the present invention is not so limited. Whereby, the length of the rod 3*a* can be adjusted according to user's requirements.

Figure 9:
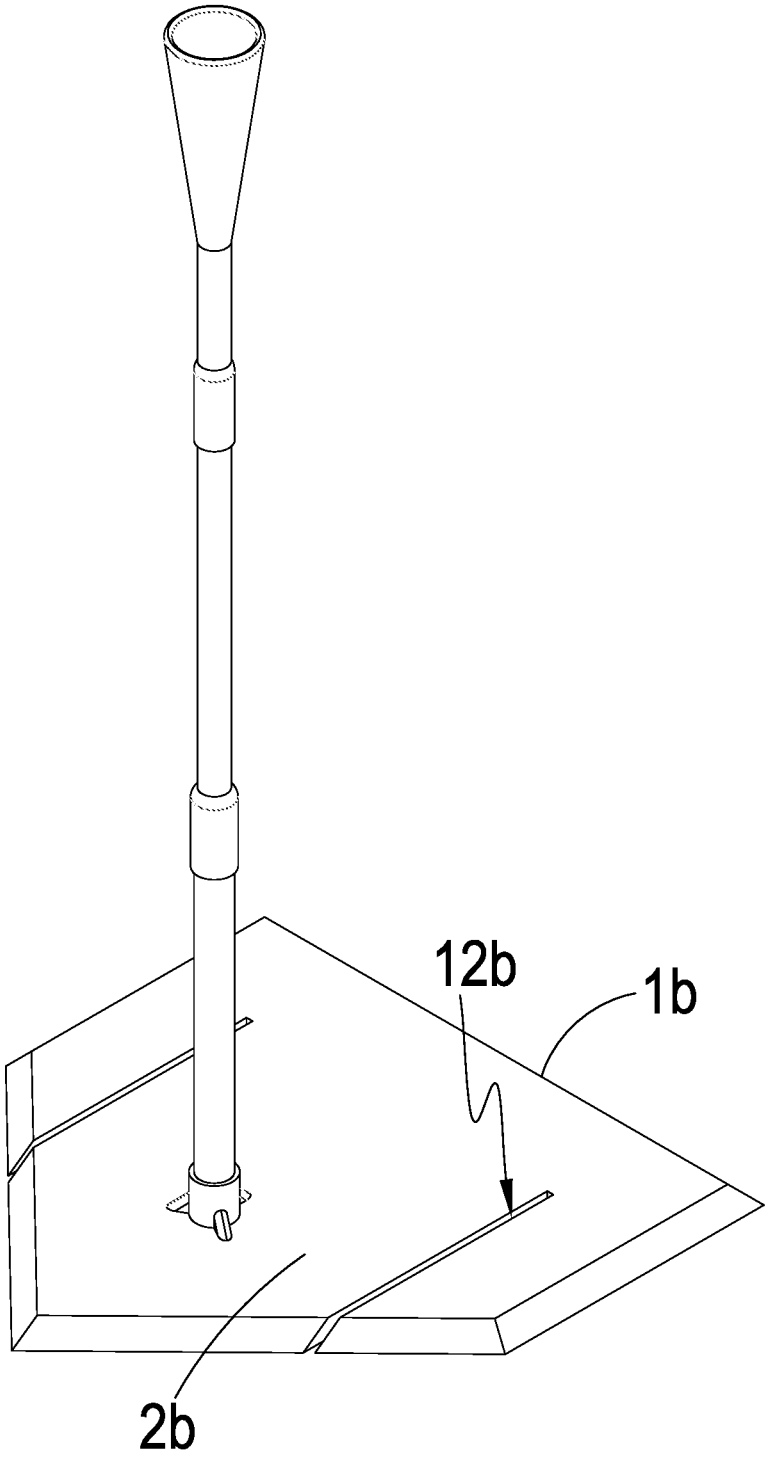
FIG. 9 is a perspective view of a third preferred embodiment according to the present invention.

Furthermore, referring to FIG. 9, a third preferred embodiment is shown. The present embodiment is almost similar to the above embodiments except a second rubber pad 2*b* is integrated with a first rubber pad 1*b* such that a user may directly cut the second rubber pad 2*b* and a swing space 12*b* out of the first rubber pad 1*b*, thereby increasing manufacturing convenience and quickness, and a connection portion is defined between the first rubber pad 1*b* and second rubber pad 2*b*.

Figure 10:
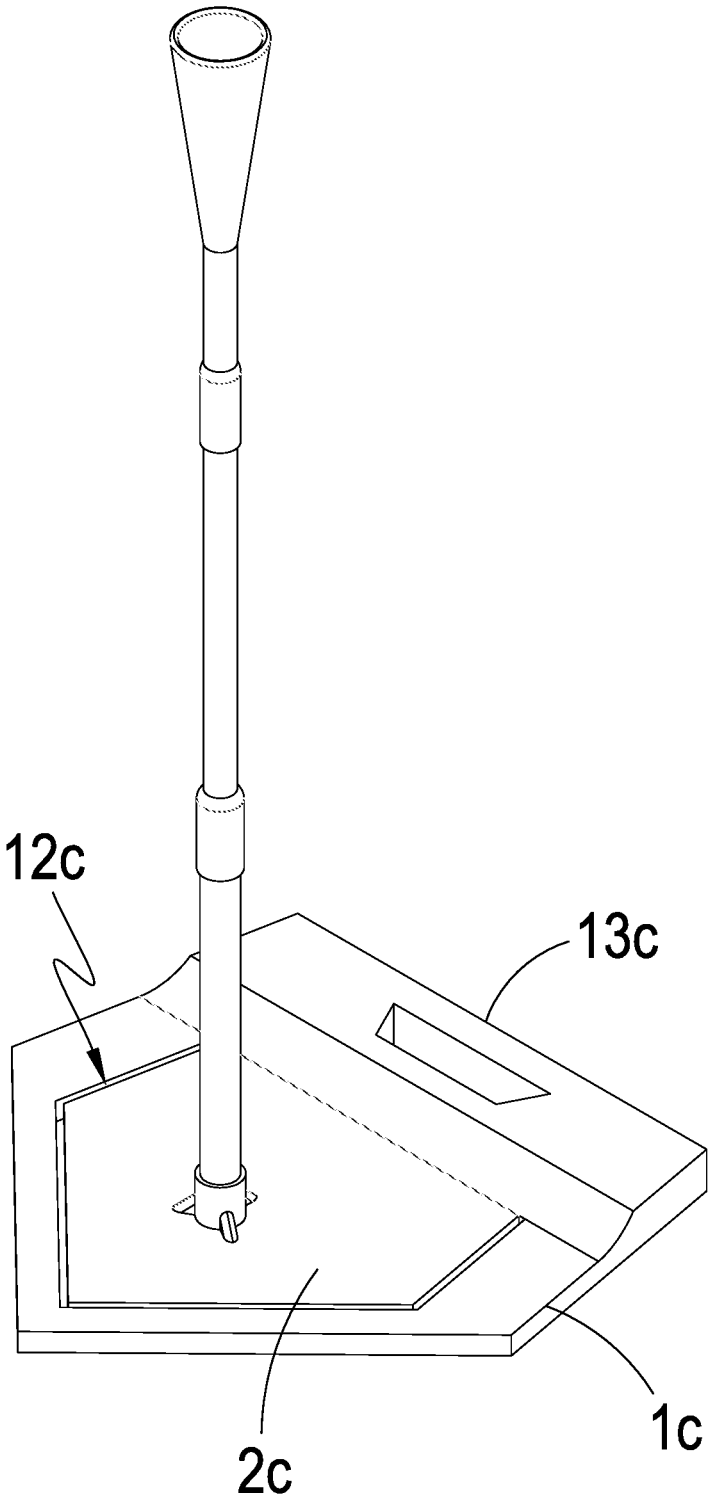
FIG. 10 is a perspective view of a fourth preferred embodiment according to the present invention.

Referring to FIG. 10, a fourth preferred embodiment is shown. The present embodiment is almost similar to the above embodiments except a swing space 12*c* will be positioned on the center of the first rubber pad 1*c*, and a second rubber pad 2*c* will be positioned inside the swing space 12*c* in the present invention so that the first rubber pad 1*c* will surround the second rubber pad 2*c*, where the shapes of the first rubber pad 1*c* and second rubber pad 2*c* are not limited. Furthermore, a thickened portion 13*c* is formed on the first rubber pad 1*c*, thereby strengthening the center of gravity of the first rubber pad 1*c*, capable of reducing the overturn chance of the first rubber pad 1*c* and therefore the damage chance of the entirety.

Therefore, the strike exerciser structure of the present invention has the following advantages over the prior arts:

1. the swing effect of the swing portion 21 is used to absorb the strike force, allowing the entirety not to be overturned so that the damage chance can be reduced to extend the service life.
2. The rod 3 can be returned to its original position through the spring-back effect of the swing portion 21, allowing a user to do the uninterrupted exercise to improve the use convenience.
3. The swing space 12 allows the oscillation of the swing portion 21 to be smoother so as to reduce the transmission chance of the strike force to the first rubber pad 1, thereby preventing the first rubber pad 1 to be overturned.

I claim:

1. A strike exerciser structure, comprising:

a first rubber pad, defined with a swing space;

a second rubber pad, in movable connection with one side of said first rubber pad and positioned inside said swing space, said second rubber pad comprising a swing portion and connection portion, said connection portion in connection with said first rubber pad, and said swing portion extended from one side of said connection portion;

a rod, one end thereof in connection with said swing portion; and a placement portion, configured on one end of said rod away from said swing portion, allowing a placement of a ball; and wherein a groove is formed in said second rubber pad and located between said swing portion and said connection portion, wherein said second rubber pad is elastic to allow said swing portion to move, in direction away from an original position, relative to said connection portion that is connected to said first rubber pad, said swing portion being returnable back to the original position through elasticity of said second rubber pad; and wherein the first rubber pad comprises a thickened portion.

2. The structure according to claim 1, wherein said second rubber pad is integrated with said first rubber pad.

3. The structure according to claim 1, wherein said second rubber pad is connected to said first rubber pad through rubber adhesive with hot pressing.

* * * * *